US010647550B2

(12) United States Patent
Paul

(10) Patent No.: US 10,647,550 B2
(45) Date of Patent: May 12, 2020

(54) OPERATING DEVICE FOR A TUBE LIFTER AND TUBE LIFTER

(71) Applicant: J. Schmalz GmbH, Glatten (DE)

(72) Inventor: Norman Paul, Schramberg (DE)

(73) Assignee: J. Schmalz GMBH, Glatten (DE)

( * ) Notice: Subject to any disclaimer, the term of this patent is extended or adjusted under 35 U.S.C. 154(b) by 0 days.

(21) Appl. No.: 16/284,403

(22) Filed: Feb. 25, 2019

(65) Prior Publication Data

US 2019/0276279 A1 Sep. 12, 2019

(30) Foreign Application Priority Data

Mar. 12, 2018 (DE) ..... 10 2018 105 606

(51) Int. Cl.
*B66C 1/02* (2006.01)
*B66C 13/20* (2006.01)

(52) U.S. Cl.
CPC ..... *B66C 1/0256* (2013.01); *B66C 1/0218* (2013.01); *B66C 1/0225* (2013.01); *B66C 13/20* (2013.01)

(58) Field of Classification Search
CPC ... B66C 1/0218; B66C 1/0225; B66C 1/0256; B66C 1/0275; B66C 13/20; B25J 15/0625; B25J 15/0633; B25J 15/0641; B25J 15/065; B25J 15/0658
USPC ..... 294/186, 187; 414/627
See application file for complete search history.

(56) References Cited

U.S. PATENT DOCUMENTS 4,413,853 A * 11/1983 Andersson ..... B66C 1/0293 294/186
5,039,274 A * 8/1991 Bennison ..... B65G 47/914 198/468.4
5,330,314 A * 7/1994 Bennison ..... B66C 1/0212 294/186
5,431,469 A * 7/1995 Ohno ..... B66C 1/0212 294/185
5,934,723 A * 8/1999 Schmalz ..... B66F 3/35 294/186

(Continued)

FOREIGN PATENT DOCUMENTS

DE 10038013 B4 11/2005
DE 202016104731 U1 9/2016

(Continued)

OTHER PUBLICATIONS

German Office Action for German Application No. 10 2018 105 606.0, filed Mar. 12, 2018, pp. 1-6, dated Nov. 10, 2018.

(Continued)

*Primary Examiner* — Dean J Kramer
(74) *Attorney, Agent, or Firm* — Bond Schoeneck & King, PLLC; George McGuire

(57) ABSTRACT

The invention relates to an operating device for a tube lifter having a lifting tube that has a tube interior and can be shortened by applying a vacuum to the tube interior, and having a suction grip device arranged on one end of the tube lifter, which suction grip device can be supplied with a vacuum through the tube interior, the operating device having a suction port for fluid communication with the suction grip device, a lifting tube port for fluid communication with the tube interior of the lifting tube, and a valve for controlling the fluid communications.

22 Claims, 7 Drawing Sheets

(56) References Cited

U.S. PATENT DOCUMENTS

| | | | | |
|---|---|---|---|---|
| 6,076,872 | A * | 6/2000 | Harter | B65G 47/917 294/186 |
| 8,109,548 | B2 * | 2/2012 | Jansson | B66C 1/0256 294/186 |
| 9,061,868 | B1 | 6/2015 | Paulsen et al. | |
| 2015/0098781 | A1 | 4/2015 | Moore et al. | |

FOREIGN PATENT DOCUMENTS

| | | | | |
|---|---|---|---|---|
| WO | 2007094720 | A1 | 8/2007 | |
| WO | WO-2007094720 | A1 * | 8/2007 | B66C 1/0256 |

OTHER PUBLICATIONS

Non-translated German Search Report for EP19161066, dated Jul. 31, 2019, pp. 1-5.

* cited by examiner

OPERATING DEVICE FOR A TUBE LIFTER AND TUBE LIFTER

CROSS REFERENCE TO RELATED APPLICATION

The present application relates and claims priority to German Application No. 102018105606.0, filed Mar. 12, 2018, the entirety of which is hereby incorporated by reference.

DESCRIPTION

The invention relates to an operating device for a tube lifter having a lifting tube that has a tube interior and can be shortened by applying a vacuum to the tube interior.

Tube lifters are vacuum handling devices by means of which loads can be grasped, lifted, optionally moved and then set down again by means of a vacuum. The lifting force is exerted by means of a lifting tube, i.e. by means of a tube that is generally formed like a pair of bellows, can be reversibly extended and retracted along the longitudinal extension thereof, and can be retracted by applying a vacuum to the tube interior thereof and then extended by releasing the vacuum prevailing therein. A suction grip device is generally attached to one end of the lifting tube. The vacuum required for the suction grip device is generally provided by the vacuum prevailing in the lifting tube. In order to lift an object, the suction grip device of the tube lifter is lowered and placed onto the object that is to be suctioned and lifted. If a vacuum is provided as far as the suction grip device, the object will then be suctioned.

In order to operate the suction gripper or the lifting tube, and in particular to adjust the vacuum prevailing in the lifting tube and if necessary to release said vacuum by means of a controlled inflow of ambient air, the operating device is provided with valve means. The vacuum state in the suction grip device of the tube lifter is generally also controlled by means of the operating device. An object to be handled can therefore be suctioned and raised or released by the suction grip device.

DE 10 2008 028 205 C5 discloses a generic operating device for tube lifters, comprising a handle which has a trigger that is similar to a pistol trigger and can be actuated with one hand. When the trigger is actuated, a control valve is firstly opened, by means of which valve an inflow of ambient air into the lifting tube is controlled. Upon further actuation beyond a pressure point, another ventilation means is opened, which allows a considerable inflow of ambient air into a connection tube leading to the suction grip device. This additional ventilation of the suction grip device ensures that the workpiece is intentionally released from the suction grip device.

Operating devices of this kind allow intuitive operation because, when the operating element is actuated, the lifting tube is firstly ventilated and as a result an extension of the lifting tube is initiated under the action of the gravitational force of the suctioned load, and the suction grip device is lowered together with the suctioned object. Only after the operating element is depressed further is complete ventilation of the suction grip device carried out, which allows the suctioned object to be released. The load is therefore automatically lowered before it is released.

In order to operate known suction lifters as described above, the operator has to bend down or otherwise compensate height differences by changing posture. In particular, the operator's hands and arms must follow the changing position of the operating device over the entire lifting movement of the tube lifter, more specifically while an object to be handled is being lifted as well as lowered and set down. This places a high burden on the operator. Handling objects in tall stacks in particular proves problematic because, in this situation, an operator has to work in an awkward posture. Furthermore, this can make operation imprecise, which compromises the operational safety. Uncontrolled changes in the position of the operating device or unintentional rapid ventilation can pose a risk to the manipulated objects and/or to the operator. If, for example, an operating error results in the suction grip device and the operating device connected thereto moving rapidly upwards while the operator is in a bent or bowed position, there is a danger to the operator.

The present invention addresses the problem of making tube lifters more comfortable for an operator to operate, and minimizing the resulting physical burden on the operator.

This problem is solved according to the invention by an operating device of the type mentioned at the outset, the manually actuable operating element being designed as a manually grippable and rotatable rod that can slide through the operator's hand during operation when the suction grip device is being raised or lowered.

The proposal according to the invention makes it possible to operate the operating device independently of the operator's height or posture. If the manually rotatable rod has a sufficient longitudinal extension, the operator's body position does not need to be changed when lowering and raising the suction grip device. A grippable length of the rotatable rod is, for example, at least 30 cm, in particular at least 50 cm, more particularly at least 70 cm and in particular no more than 250 cm, more particularly no more than 200 cm, even more particularly no more than 150 cm and most particularly no more than 100 cm. In this case, the operator allows the rod to slide through the hand that is gripping the rod when raising or lowering. As a result, the operator does not have to bend or kneel when picking up or setting down an object to be lifted, but can instead allow the rod and thus also the operating device to slide through his hand, which constitutes a significant increase in comfort. However, this does not preclude the possibility of the rod having a contour for increasing the manual grippability. Moreover, the operational safety is also increased by the invention, because the operator can concentrate on controlling the operating device and does not also have concern himself with changing his position to adapt to the current lifting height of the operating device. In addition, there is no longer the danger of the operator's upper body, and in particular the operator's head, coming close to the operating device when it is being lowered or coming close to the suction grip device, and therefore the danger of being hit by the device if it is suddenly raised unintentionally is removed.

It is unlikely that the rod from the solution according to the invention would be rotated unintentionally. In contrast, the known solution mentioned at the outset in which the trigger is actuated by being pressed involves a certain risk that pressing too far and thus rapidly ventilating the suction grip device will result in the held load being lowered too quickly. An extreme case in which the load being unintentionally released by full actuation of the trigger cannot be ruled out. In particular, if a load has been held at a great height, damage to the load may occur or the operator or bystanders may be injured. In the present solution, this danger is non-existent or exists to a much lesser degree, because it is unlikely that the rod would be rotated in an uncontrollable manner. The solution according to the invention therefore also increases the operational safety of the operating device.

It is further proposed for the rotatable rod to extend substantially vertically during operation, although the effect according to the invention could also be achieved, to an at least satisfactory extent, by a certain incline with respect to the vertical.

It would also be conceivable for the rotatable rod to be length-adjustable. The rod could also be designed to be telescopic, such that it could be length-adjusted, depending on height or the object to be moved, to an optimum length for the particular operator. It should also be pointed out here that, in addition to the rotatable rod, another manually grippable rod is preferably and expediently provided for being grasped with the operator's other hand. This other manually grippable rod is used for guiding the operating device or the suction grip device together with an object suctioned thereto. It is therefore usually, and preferably, non-rotatable.

Regarding the direction of impact of the present invention described above, it is advantageous for the operating device to be arranged between a lower end of the lifting tube and an upper end of the suction grip device, and for the rod to preferably extend substantially in parallel with the extension of the lifting tube. The rotatable rod and the optionally provided grippable rod preferably extend over preferably the entire vertical extension of the operating device, the suction port and the lifting tube port being positioned beyond the extension of the rod in the upward and downward directions, respectively. This is not obligatory, however.

According to another concept regarding the arrangement of the components of the operating device, it is further proposed for the operating device to comprise a centrally arranged suction tube that extends substantially vertically during operation, and for the rotatable rod to extend in parallel with the suction tube. The same applies to the optionally provided other manually grippable rod.

It would be conceivable to operate the tube lifter entirely by providing a single ventilation valve if the opening cross section were sufficiently large and preferably steplessly adjustable. Nevertheless, it has proved advantageous for the valve device to comprise a ventilation valve for setting down an object to be suctioned, which can be brought into a hold position and into a ventilation position, in the ventilation position a flow path between the surroundings and the suction port and/or a flow path between the surroundings and the lifting tube port being open, and in the hold position said flow path being substantially closed. In this way, a suctioned object can be released by deliberately actuating said ventilation valve.

It is further proposed to design the operating device such that when the operating device is actuated by manually rotating the rod from a neutral position towards an end position, the control valve is firstly shifted from the closed position towards the open position. In this way, it is ensured that the operator actuates a single function, namely the adjustment of the control valve, by means of a single control measure, namely firstly manually rotating the rod.

If the aforementioned ventilation valve is provided close to the control valve for setting down a suctioned object, it has proved advantageous for the rod to arrive at an intermediate position, which is preferably designed as a pressure point, as a result of manual rotation of the rod starting from the neutral position towards the end position, and for it to be possible to overcome said intermediate position by further rotating the rod, and for the ventilation valve to thus be shifted from the hold position towards the ventilation position. Said intermediate position, which is preferably designed as a pressure point, can be communicated to the operator in a tactile or other manner by means of the tangible pressure point or in another way, for example by means of a tangible locking. If, in this situation, the operator wishes to set down an object, he should further rotate the rod in order to shift the ventilation valve into the ventilation position thereof.

It can also prove advantageous for the valve device to comprise a blocking member which is adjustable between a blocking position and an opening position, in the blocking position a flow path between the lifting tube port and the suction port being substantially closed off, and in the opening position said path being open. When load is being set down, a blocking member of this type can prevent the entire lifting tube from being ventilated and the vacuum-generating device or vacuum-guiding and distributing line system from being loaded with large mass flow rates, which could jeopardize the maintenance of a vacuum that is required for operation. In a development of this concept, it has proved advantageous for the blocking member to also be actuable by rotating the rod.

It is further proposed for the blocking member and the ventilation valve to be preferably mechanically forcibly intercoupled such that, by bringing the ventilation valve into the ventilation position, the blocking member is shifted towards the blocking position thereof such that the flow path between the lifting tube port and the suction port is closed off. As a result of said forced coupling, together with the design and setup of the components of the ventilation valve and of the blocking member, the vacuum in the lifting tube is correctly and necessarily not significantly affected when an object is being set down. Instead, the suction grip device simply rises as far as a presettable balanced position without a load.

According to one embodiment, it is proposed for the rotatable rod to be designed or mounted so as to be self-locking, such that it substantially remains in a temporary rotational position, and therefore does not automatically move back into a neutral position when released. The advantage of this embodiment is that the operating device is overall better protected against operating errors, and results in greater operating comfort, specifically when the device is move upward or downward and the rod therefore slides through the operator's hands. The operator therefore does not have to apply constant torque to the rod. As a result of the rod remaining in the temporary rotational position thereof, the suction lifter overall assumes one of the balanced positions corresponding to valve actuation and remains there. An undesirable dynamic that could lead to further operational errors is therefore prevented, and the operator has enough time to deliberately plan and execute the further operation.

However, in an alternative embodiment, the rotatable rod can be pretensioned towards a neutral position, such that it automatically moves back towards the neutral position when released.

It can also prove advantageous for the operating device to comprise a first housing body on the lifting tube side which is at the top during operation and forms the lifting tube port, and for the control valve to be arranged in or on said upper housing body. Providing a housing body makes it possible to also accommodate the control valve, and to provide the openings which interact with the control valve and delimit the flow path from the surroundings to the lifting tube port.

It can also prove advantageous for the operating device to comprise a second housing body on the suction grip device side which is at the bottom during operation and forms the suction port for connecting to the suction grip device, and for the optionally provided ventilation valve and/or the optionally provided blocking member to be arranged in or on said second lower housing body.

It is further proposed for a suction tube that extends substantially vertically during operation to extend between the first upper housing body and the second lower housing body, and for the rotatable rod to extend in parallel with said tube. Said suction tube makes it possible to achieve a vacuum communication or fluid communication between the upper housing body and the lower housing body, and to achieve a sufficient distance for accommodating the rotatable rod. As explained above, it can prove advantageous for another manually grippable rod to be provided parallel to the rotatable rod, such that, from the perspective of an operator gripping one of the two rods in each hand, the suction tube extends between the two rods.

In principle, the aforementioned valves can be designed in any way, as long as a sufficient flow cross section can be opened and closed and, with regard to the control valve, a variable flow cross section can be controlled set by the operator in a controlled manner. With regard to an embodiment that can be produced in a functionally reliable and economical manner, it can prove advantageous for the control valve to comprise a first valve plate which is translationally movable or can be pivoted in the plane thereof and can be adjusted by rotating the manually rotatable rod.

It can likewise prove advantageous for the ventilation valve to comprise a second valve plate which is translationally movable or can be pivoted in the plane thereof and can be adjusted by rotating the manually rotatable rod.

It can accordingly prove advantageous for the blocking member to comprise a third valve plate which is translationally movable or can be pivoted in the plane thereof and can be adjusted by rotating the manually rotatable rod.

In order to make it possible to adjust the control valve by rotating the manually rotatable rod, in the simplest case a valve component of the control valve, for example a valve plate, can be designed for conjoint rotation with the rod, or can be coupled to the rod for conjoint rotation therewith. It can also prove advantageous, though, for transmission components comprising a mechanical belt drive or gear drive or a pivotable projection or electromechanical transmission components to be arranged between the manually rotatable rod and the control valve and/or the ventilation valve and/or the blocking member.

In particular if the ventilation valve and the blocking member are forcibly coupled, it has proved advantageous for the second and third valve plates to have a common pivot axis about which they can be pivoted by means of the manually rotatable rod, the common pivot axis preferably extending in parallel with the manually rotatable rod. In this way, an operationally safe adjustment of said two valve plates that is easy to produce can be achieved.

It has also proved advantageous for the second and third valve plates to be mutually spaced orthogonally relative to the respective plate planes thereof. In this case, they can be connected for conjoint rotation having the same rotational axis or rotational shaft and so as to delimit a volume having a large flow cross section that can be used for reducing the vacuum, in particular when a suctioned object is being set down.

It has also been proved advantageous for the ventilation valve to be accommodated inside a housing body that is open to the atmosphere but sealed against the flow route within the suction grip device and the operating device. This housing body can be provided within the lower housing body.

The invention also relates to a tube lifter comprising an operating device according to the invention.

Further features, details and advantages of the invention can be found in the enclosed claims, in the drawings and in following description of preferred embodiments of the invention.

Figure 1:
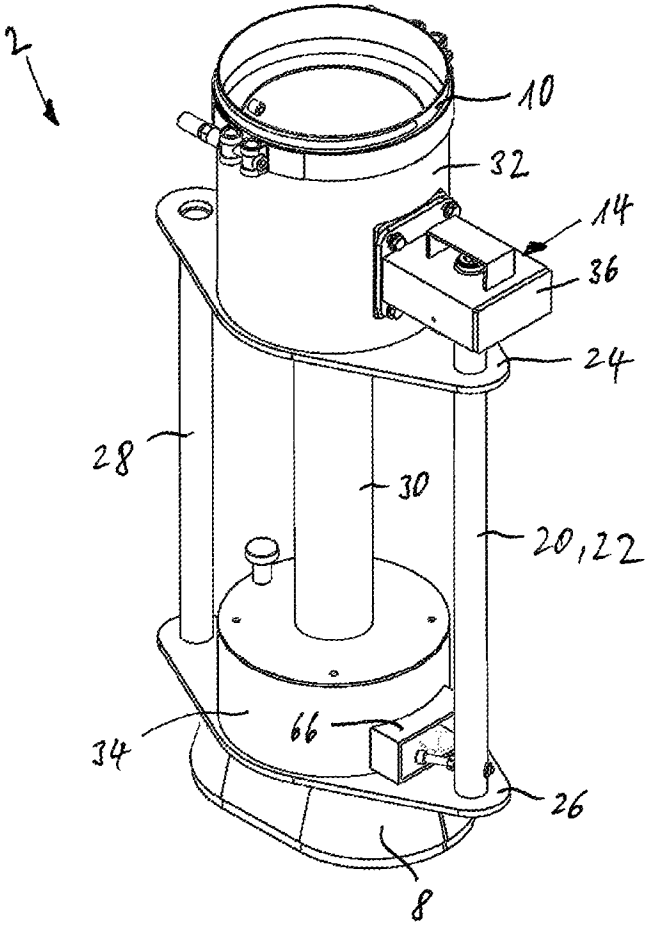
FIG. 1 is a perspective view of an embodiment of an operating device for a tube lifter according to the invention, comprising a manually rotatable rod as an operating element.
Figure 2:
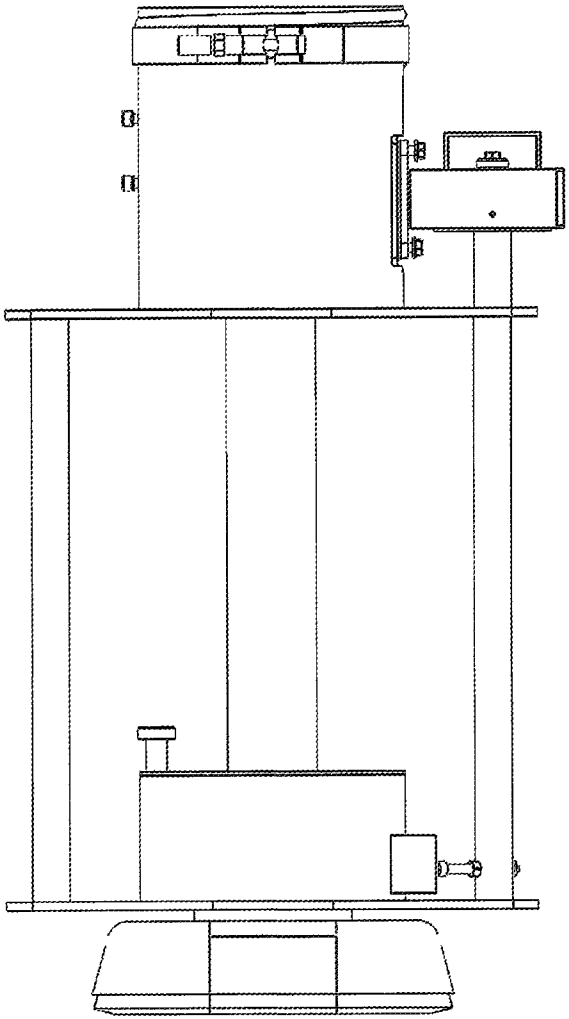
FIG. 2 is a side view of the operating device according to FIG. 1.
Figure 3:
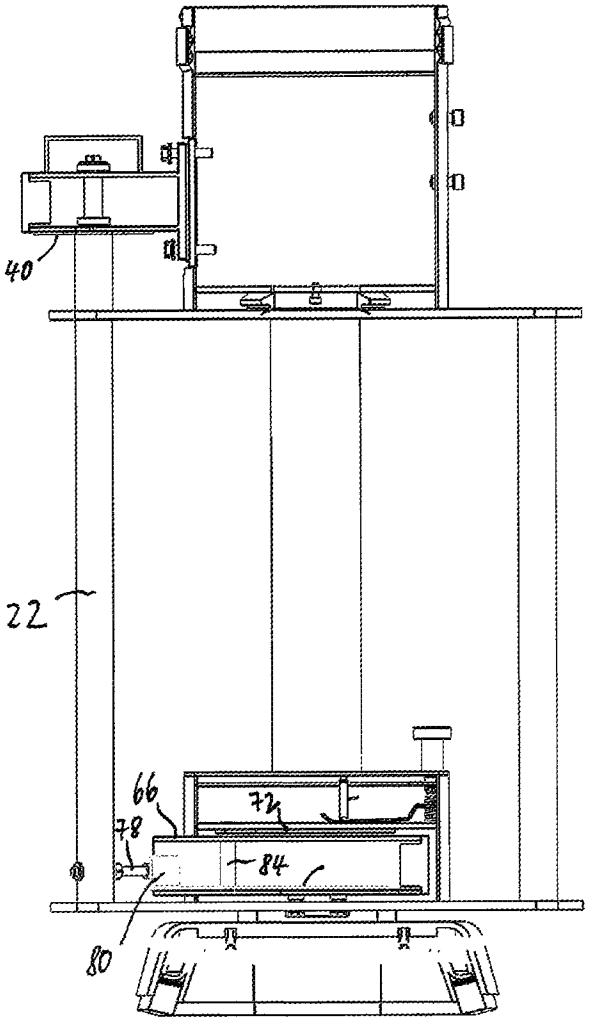
FIG. 3 is a longitudinal section through the device according to FIG. 1.
Figure 4A:
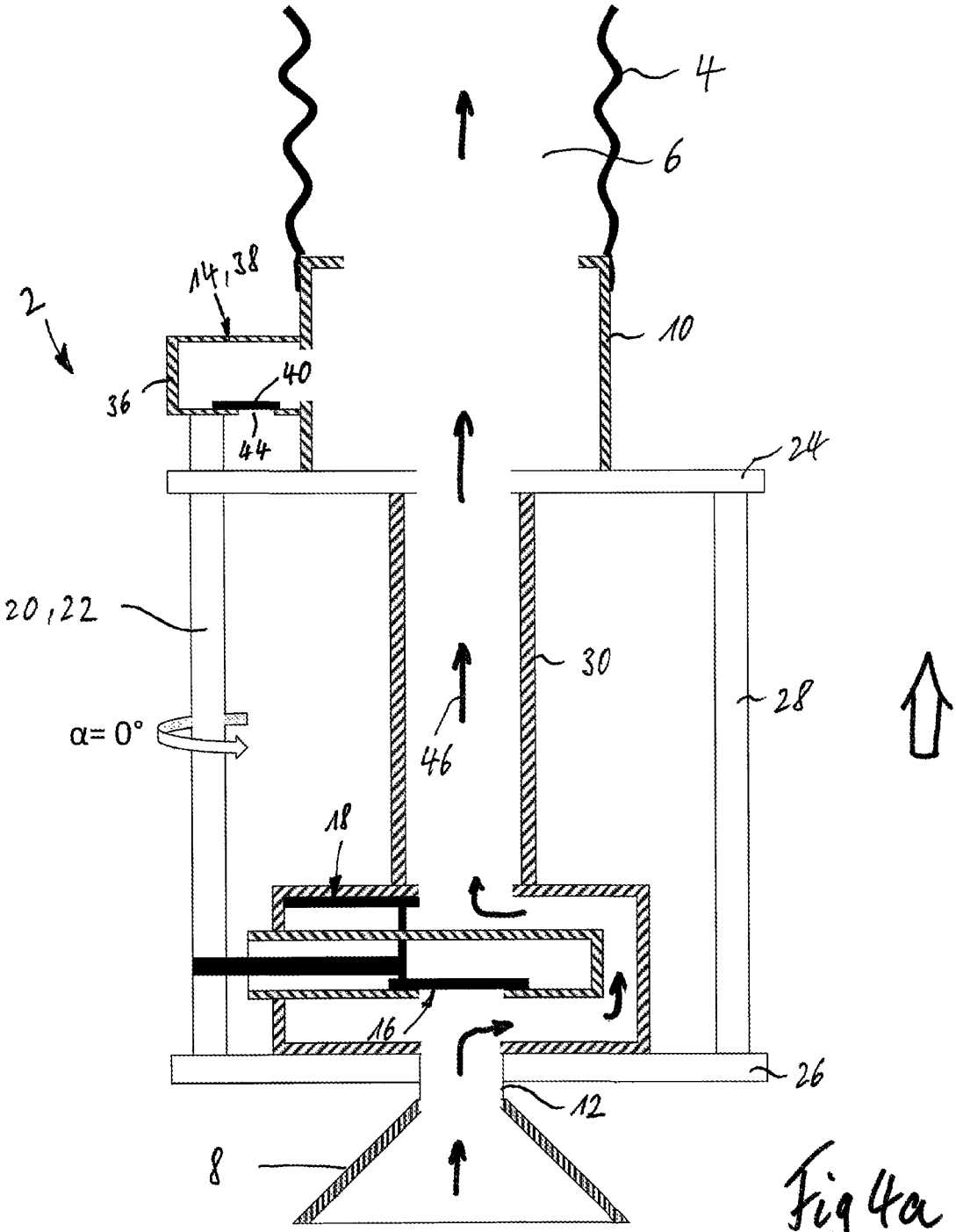
Figure 4B:
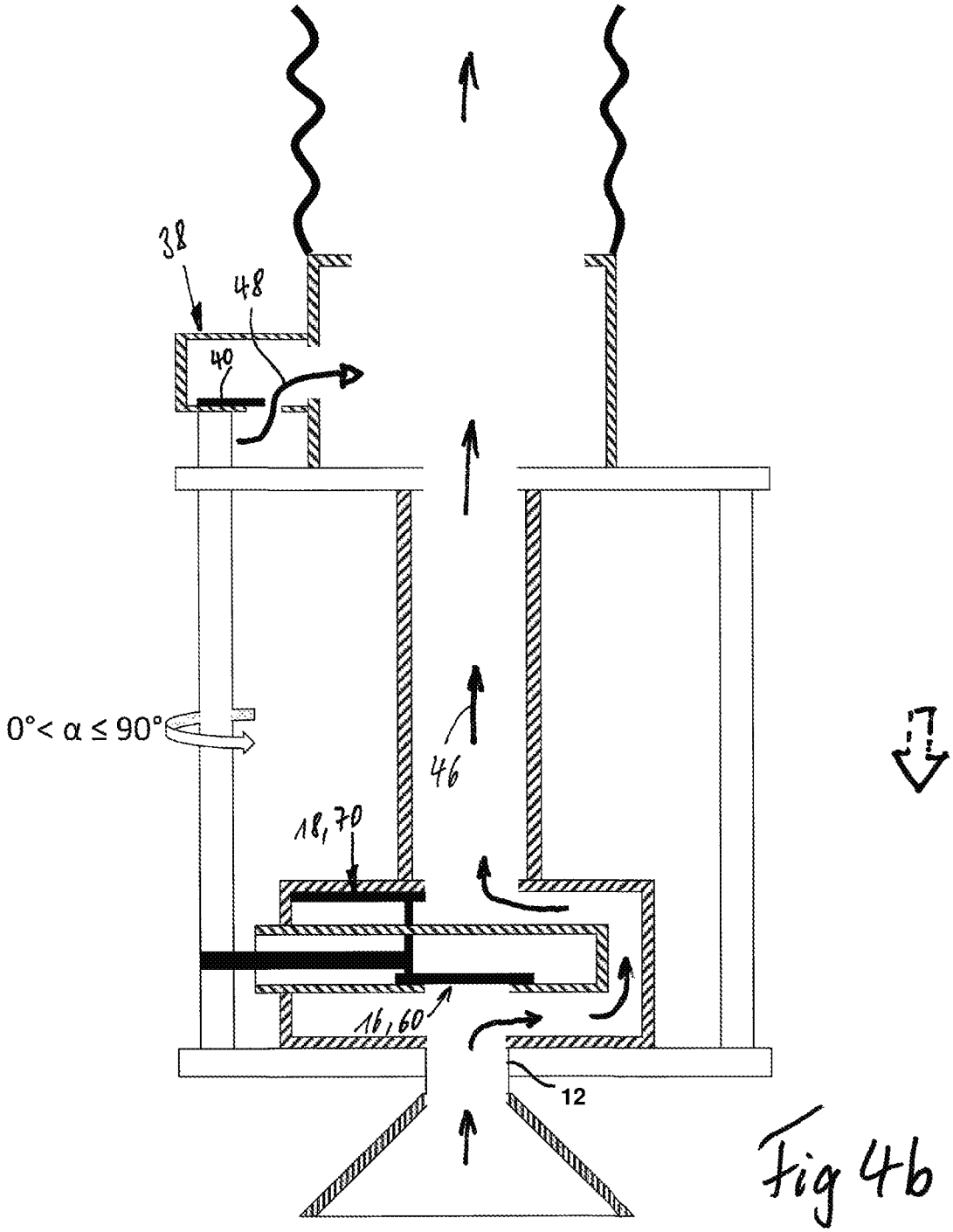
Figure 4C:
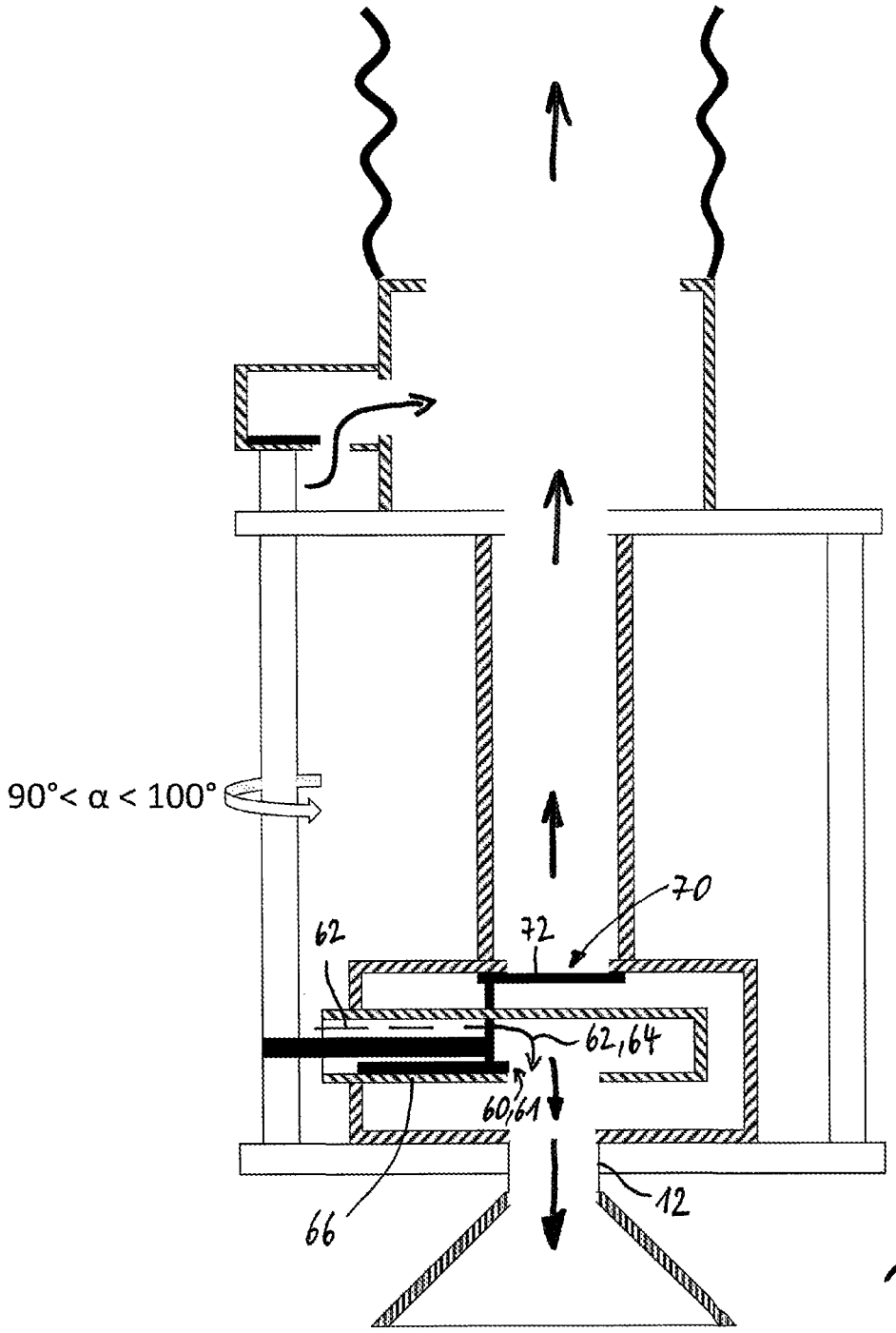
Figure 5:
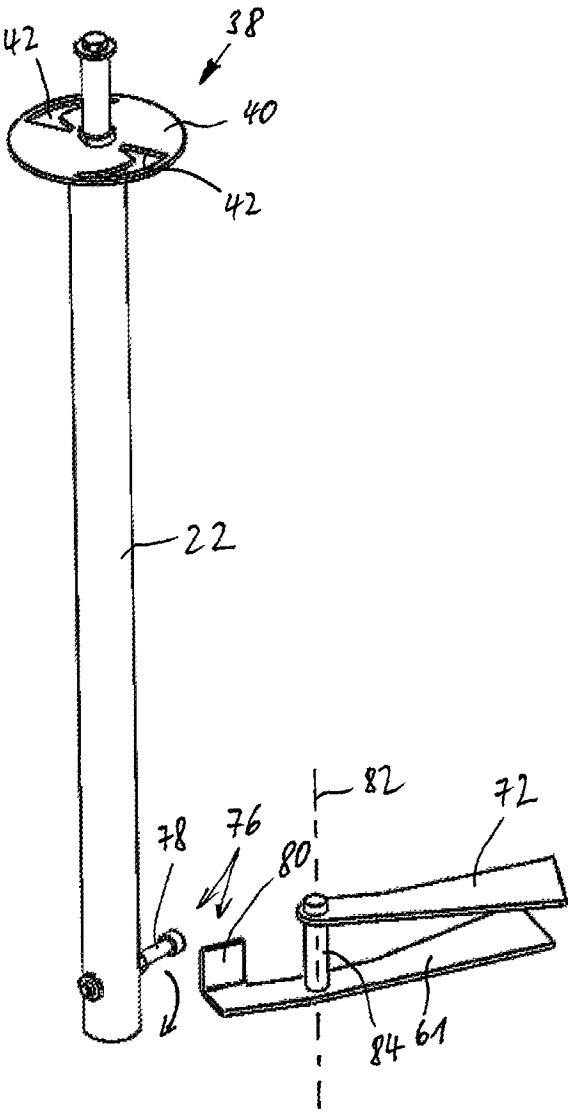

FIG. 4*a* to *c* are each schematic views of different operating positions of the operating device; and FIG. 5 is a perspective view of the rotatable rod comprising valve components.

The drawings show an operating device for a tube lifter, which device is designed according to the invention and denoted overall by reference sign 2, and also comprises a lifting tube 4 that has a tube interior 6 to which a vacuum can be applied, and a suction grip device 8 for suctioning, lifting, transporting and then setting down an object. The operating device 2 comprises a lifting tube port 10 for the lifting tube 4 and a suction port 12 for the suction grip device 8. The operating device 2 further comprises valve means 14, 16, 18, which will be described in more detail, and a manually actuable operating element 20.

According to the invention, this operating element 20 is designed as a manually grippable and rotatable rod 22 that can slide through the operator's hand during operation when the suction grip device is being raised or lowered.

The operating device 2 comprises a mounting plate 24, which is at the top during operation, and a lower mounting plate 26, between which plates the operating element 20 is arranged in the form of the rotatable rod 22. The rod 22 is therefore mounted so as to be rotatable relative to the mounting plates 24, 26. The longer the rotatable rod 22, the larger the vertical distance between the mounting plates 24, 26. It can be seen from the drawings that a second rod 28 is arranged in parallel with the rotatable rod 22 between the mounting plates 24, 26. This second rod 28 is preferably non-rotatable. It is only used to support, engage and guide the operating device 2. A suction tube 30 also extends centrally and substantially vertically between the two mounting plates 24, 26, which tube provides a flow route for vacuum communication between the lifting tube 4 and the suction grip device 8 in a manner that will be explained below.

In this embodiment shown by way of example, a first housing body 32 is also provided on the upper mounting plate 24, and a second housing body 34 is provided on the lower mounting plate 26. The housing bodies 32, 34 delimit a flow route and receive or retain the valve means 14 to 18, which are yet to be described individually.

In the case shown by way of example, the rotatable rod 22, which is shown in FIG. 5 detached from other housing components, extends through the upper mounting plate 24 into an attached housing 36 of the valve means 14. These valve means 14 form a control valve 38 of the operating device. The control valve 38 comprises a pivotable first valve plate 40 that is attached to the rotatable rod 20 orthogonally to the longitudinal extension of said rod for conjoint rotation therewith, which can be best seen in FIG. 5. By way of example, the first valve plate 40 comprises two openings 42 that can be brought into a position aligned with an inflow opening 44 in the attached housing 36. The openings 42 are designed such that the flow cross-section can be adjusted, preferably steplessly, from zero to a maximum value. As a result, the vacuum prevailing in the tube interior 6 can be steplessly adjusted by rotating the rod 22 between a closed position of the control valve 38 and an open position. In the embodiment shown here by way of example, the rod 22 has to be rotated from a neutral position of 0 by 90° for this purpose.

FIG. 4*a* shows the control valve 38 in the closed position, such that the flow route indicated by arrow 46 results from the applied vacuum and an object to be lifted can be suctioned. If, in the state shown in FIG. 4*a*, an object is suctioned under the suction grip device 8, the lifting tube 4 contracts and the operating device 2 is raised upward together with the suctioned object. Then, if the control valve 38 is gradually opened by rotating the rod 22, as shown in FIG. 4*b*, air flows (arrow 48) from the surroundings through the control valve 38 into the interior of the upper housing body 10 and into the lifting tube 4. The vacuum prevailing therein is gradually decreased depending on the valve position, with the result that the lifting tube 4 extends again and the operating device 2 and an object suctioned thereto can be lowered. When a specified opening cross section of the control valve 38 is reached, the tube lifter, together with the suctioned object, assumes a corresponding balanced position, i.e. a corresponding lifting height. If the rotatable rod 22 is designed to be self-locking, i.e. is not pretensioned towards an end position, the operator can release the rotatable rod without the operating device 2 or the tube lifter overall moving out of an assumed balanced position.

If the operator eventually rotates the rod further, in this example 90°, until the suctioned object is completely set down, this position (90°) is communicated to the operator, preferably via a pressure point mechanism. If the operator then wishes to release the suctioned object intentionally, the rod 22 should be rotated further beyond said pressure point. As a result, the first valve plate 40 fully opens the inflow opening 44 of the control valve (see FIG. 4*c*) and the other valve means 16, 18 are operated, which is described in the following:

The valve means 16 comprise or form a ventilation valve 60 comprising a second valve plate 61 that can be brought into a hold position and into a ventilation position. In the hold position shown in FIGS. 4*a* and 4*b*, a flow path 62 between the surroundings and the suction port 12 for the suction grip device 8 is closed, such that the flow route can take the course shown by arrow 46 in FIGS. 4*a* and 4*b*. If the ventilation valve 60 is brought into the ventilation position thereof (FIG. 4*c*), the flow path 62 is therefore free and the suction port 12 is ventilated from the inside (arrow 64), such that the vacuum therein breaks and a suctioned object can be released. For this reason, the ventilation valve 60 is accommodated inside a housing body that is open to the atmosphere but sealed against the suction port 10 and is inserted into a larger lower housing body 34.

Moreover, a blocking member 70 that comprises a third valve plate 72 and can be adjusted between a blocking position and an opening position is provided in the lower housing body 34. When in the opening position, the member opens the flow route between the lower housing body 34 and the suction tube 30. When the member is in the blocking position (FIG. 4*c*), said flow route is substantially closed off. The purpose of this is that when the suction grip device 8 is ventilated, the interior of the lifting tube 4 can be sealed against said device in a substantially flow-tight manner, such that the vacuum in the lifting tube 4 does not suddenly break and result in a large mass flow rate that has to be received by the vacuum-generating means.

According to the advantageous embodiment shown here, the ventilation valve 60 and the blocking member 70, as already mentioned, are actuated by the rotatable rod 22 when the rod is rotated from the neutral position thereof by 90°, in particular by 100°. For this reason, mechanical transmission components 76, which are designed in a very simple manner by way of example, are provided between the rotatable rod 22 and the ventilation valve 60 or the blocking member 70. A projection that protrudes radially outward is provided on the rotatable rod 22 in the form of a bolt 78 that pivots together with the rod 22 when said rod is rotated. If the rod 22, shown here starting from a neutral position by way of example, is pivoted by more than 90°, the bolt 78 strikes a catch element 80 of the second valve plate 61 of the ventilation valve 60. Said second valve plate is mounted so as to be pivotable about an axis 82 that is parallel to the rod 22. By pivoting the second valve plate 61, the ventilation cross section, as indicated in FIG. 4*c*, is opened and the interior of the lower housing body 34 is ventilated. The second valve plate 61 is mounted by means of a shaft 84, to which shaft the third valve plate 72 of the blocking member 70 is hinged for conjoint rotation. This achieves a forced coupling between the second valve plate 61 of the ventilation valve 60 and the third valve plate 72 of the blocking member 70, such that both are actuated at the same time. The valve plates 61, 72 and the catch element 80 are preferably pretensioned such that, when the rod 22 is rotated back, the ventilation valve 60 assumes the closed hold position thereof, and the blocking member 70 assumes the opening position thereof.

What is claimed is:

1. Operating device for a tube lifter which comprises a lifting tube that has a tube interior and can be shortened by applying a vacuum to the tube interior, and comprising a suction grip device arranged on one end of the tube lifter, which suction grip device can be supplied with a vacuum through the tube interior, the operating device having a suction port for fluid communication with the suction grip device, a lifting tube port for fluid communication with the tube interior of the lifting tube, and valve means for controlling the fluid communications, the valve means comprising a control valve which is adjustable between a closed position and an open position, in the open position a flow path from the surroundings to the lifting tube port being open, and in the closed position said flow path being substantially closed;

and a control mechanism comprising a manually actuable operating element being provided for adjusting the control valve, characterized in that the manually actuable operating element is configured as a manually grippable and rotatable rod having a neutral position, an end position, and an intermediate position, and designed such that it can slide through an operator's hand when the suction grip device is being raised or lowered during operation, wherein when the operating device is actuated by manually rotating the rod from a neutral position towards an end position, firstly the control valve is shifted from the closed position towards the open position, and wherein the rod arrives at an intermediate position as a result of manual rotation of the rod starting from the neutral position towards the end position, and in that it is possible to overcome said intermediate position by further rotating the rod.

2. Operating device according to claim 1, characterized in that the rotatable rod extends substantially vertically during operation.

3. Operating device according to claim 1, characterized in that the rotatable rod is rotatably mounted in association with at least one of two mutually spaced mounting plates.

4. Operating device according to claim 1, characterized in that a second manually grippable rod is provided and arranged parallel to the rotatable rod.

5. Operating device according to claim 1, characterized in that the operating device is arranged between a lower end of the lifting tube and an upper end of the suction grip device, and in that the rod extends substantially in parallel with the extension of the lifting tube.

6. Operating device according to claim 1, characterized in that the operating device comprises a centrally arranged suction tube that extends substantially vertically during operation, and in that the rotatable rod extends in parallel with the suction tube.

7. Operating device according to claim 1, characterized in that the valve means comprises a ventilation valve which can be brought into a hold position and into a ventilation position, in the ventilation position a flow path between one of the surroundings and the suction port and the surroundings and the lifting tube port being open, and in the hold position said flow path being substantially closed.

8. Operating device according to claim 7, characterized in that when the rod is rotated beyond the intermediate position, the ventilation valve is shifted from the hold position towards the ventilation position.

9. Operating device according to claim 8, characterized in that the valve means comprises a blocking member which is adjustable between a blocking position and an opening position, in the blocking position a flow path between the lifting tube port and the suction port being substantially closed off, and in the opening position said path being open.

10. Operating device according to claim 9, characterized in that the blocking member can also be actuated by rotating the rod.

11. Operating device according to claim 9, characterized in that the blocking member and the ventilation valve are mechanically intercoupled such that, by bringing the ventilation valve into the ventilation position, the blocking member is shifted towards the blocking position thereof such that the flow path between the lifting tube port and the suction port is closed off.

12. Operating device according to claim 9, characterized in that the ventilation valve comprises a second valve plate which is translationally movable or can be pivoted in the plane thereof and can be adjusted by rotating the manually rotatable rod.

13. Operating device according to claim 12, characterized in that the blocking member comprises a third valve plate which is translationally movable or can be pivoted in the plane thereof and can be adjusted by rotating the manually rotatable rod.

14. Operating device according to claim 13, characterized in that transmission components comprise-a pivotable projection arranged between the manually rotatable rod and the control valve and/or the ventilation valve and/or the blocking member.

15. Operating device according to claim 13, characterized in that the second and third valve plates are mutually spaced orthogonally relative to the respective plate planes thereof.

16. Operating device according to claim 12, characterized in that the ventilation valve is accommodated inside a housing body that is open to the atmosphere but sealed against the flow route within the suction grip device and the operating device.

17. Operating device according to claim 1, characterized in that the rotatable rod is self-locking, such that it substantially remains in a temporary rotational position, and therefore does not automatically move back into a neutral position when released.

18. Operating device according to claim 1, characterized in that the rotatable rod is pretensioned towards a neutral position, such that it automatically moves back towards the neutral position when released.

19. Operating device according to claim 1, characterized in that the operating device comprises a first housing body on the lifting tube side which is at the top during operation and forms the lifting tube port, and in that the control valve is arranged in or on said upper housing body.

20. Operating device according to claim 1, characterized in that the operating device comprises a second housing body on the suction grip device side which is at the bottom during operation and forms the suction port for connecting to the suction grip device.

21. Operating device according to claim 1, characterized in that the control valve comprises a first valve plate which is translationally movable or can be pivoted in the plane thereof and can be adjusted by rotating the manually rotatable rod.

22. Tube lifter comprising an operating device for the tube lifter which comprises a lifting tube that has a tube interior and can be shortened by applying a vacuum to the tube interior, and comprising a suction grip device arranged on one end of the tube lifter, which suction grip device can be supplied with a vacuum through the tube interior, the operating device having a suction port for fluid communication with the suction grip device, a lifting tube port for fluid communication with the tube interior of the lifting tube, and valve means for controlling the fluid communications, the valve means comprising a control valve which is adjustable between a closed position and an open position, in the open position a flow path from the surroundings to the lifting tube port being open, and in the closed position said flow path being substantially closed;

and a control mechanism comprising a manually actuable operating element being provided for adjusting the control valve, characterized in that the manually actuable operating element is configured as a manually grippable and rotatable rod having a neutral position, an end position, and an intermediate position, and designed such that it can slide through an operator's hand when the suction grip device is being raised or lowered during operation, and wherein when the operating device is actuated by manually rotating the rod from a neutral position towards an end position, firstly the control valve is shifted from the closed position towards the open position, and wherein the rod arrives at an intermediate position as a result of manual rotation of the rod starting from the neutral position towards the end position, and in that it is possible to overcome said intermediate position by further rotating the rod.

* * * * *